US011643833B2

(12) United States Patent
Barnes

(10) Patent No.: US 11,643,833 B2
(45) Date of Patent: May 9, 2023

(54) MODIFIED POOL SKIMMER

(71) Applicant: Stephan Barnes, Rogers, AR (US)

(72) Inventor: Stephan Barnes, Rogers, AR (US)

( * ) Notice: Subject to any disclaimer, the term of this patent is extended or adjusted under 35 U.S.C. 154(b) by 72 days.

(21) Appl. No.: 17/501,101

(22) Filed: Oct. 14, 2021

(65) Prior Publication Data

US 2022/0049515 A1 Feb. 17, 2022

(51) Int. Cl.
*E04H 4/12* (2006.01)

(52) U.S. Cl.
CPC ..... *E04H 4/1272* (2013.01)

(58) Field of Classification Search
CPC ..... E04H 4/1272
USPC ..... 210/167.1
See application file for complete search history.

(56) References Cited

U.S. PATENT DOCUMENTS 4,212,740 A * 7/1980 Greene ..... E04H 4/1272 210/242.1
9,581,478 B1 * 2/2017 Smith ..... E04H 4/1272
2009/0159516 A1 * 6/2009 Andrei ..... E04H 4/1272 210/167.12
2015/0354242 A1 * 12/2015 Saccoccio ..... B01D 29/50 210/806
2021/0172188 A1 * 6/2021 Afshar ..... B01D 29/58

* cited by examiner

*Primary Examiner* — Fred Prince
(74) *Attorney, Agent, or Firm* — Chris Tanner; FYPA PLLC

(57) ABSTRACT

An improved skimmer system is disclosed, as well as method of use and manufacture. The skimmer system comprises a base-basket and a moving section, where the moving section has two or more louvres defined therein. During use, the base-basket will likely remain stationary, but the moving section will float-travel along a vertical axis defined by the louvres. The skimmer system enables effective skimming regardless of potential changes in level of the pool water. The louvres within the moving section correspond with a plurality of slots within the base-basket. During installation of the system, a user would first position the base-basket within the bottom of any (existing) circular opening which normally houses a pool skimmer. Then, the user takes the movable section and loads it in on top of the base-basket.

17 Claims, 16 Drawing Sheets

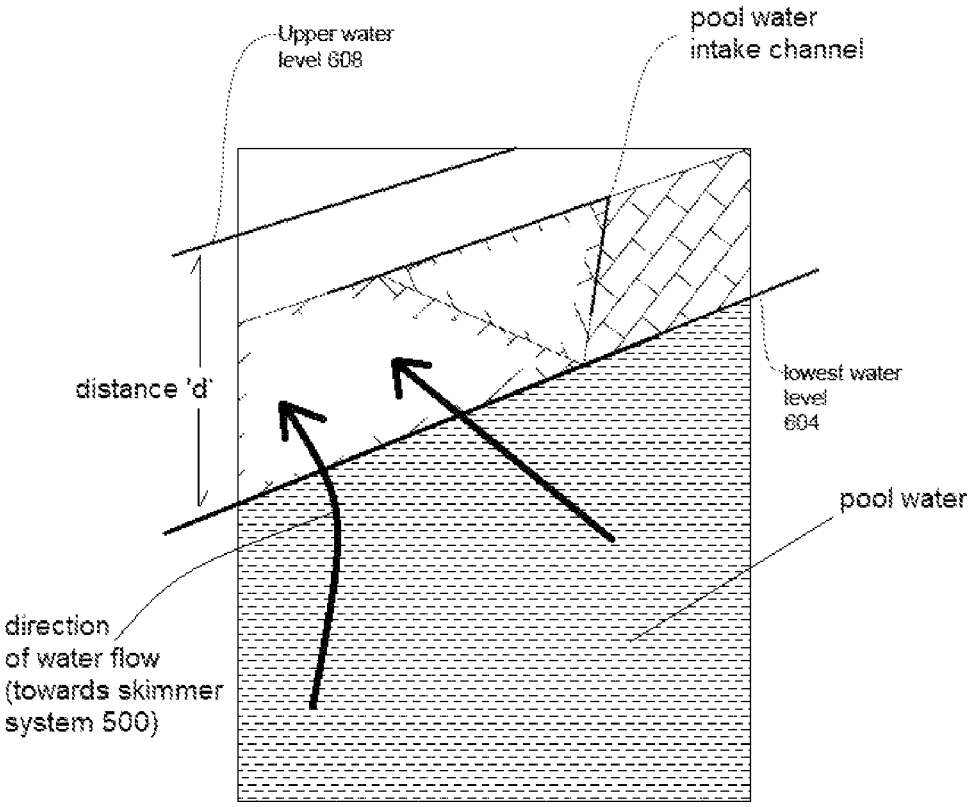
FIG. 6 (pool water levels and operating range)

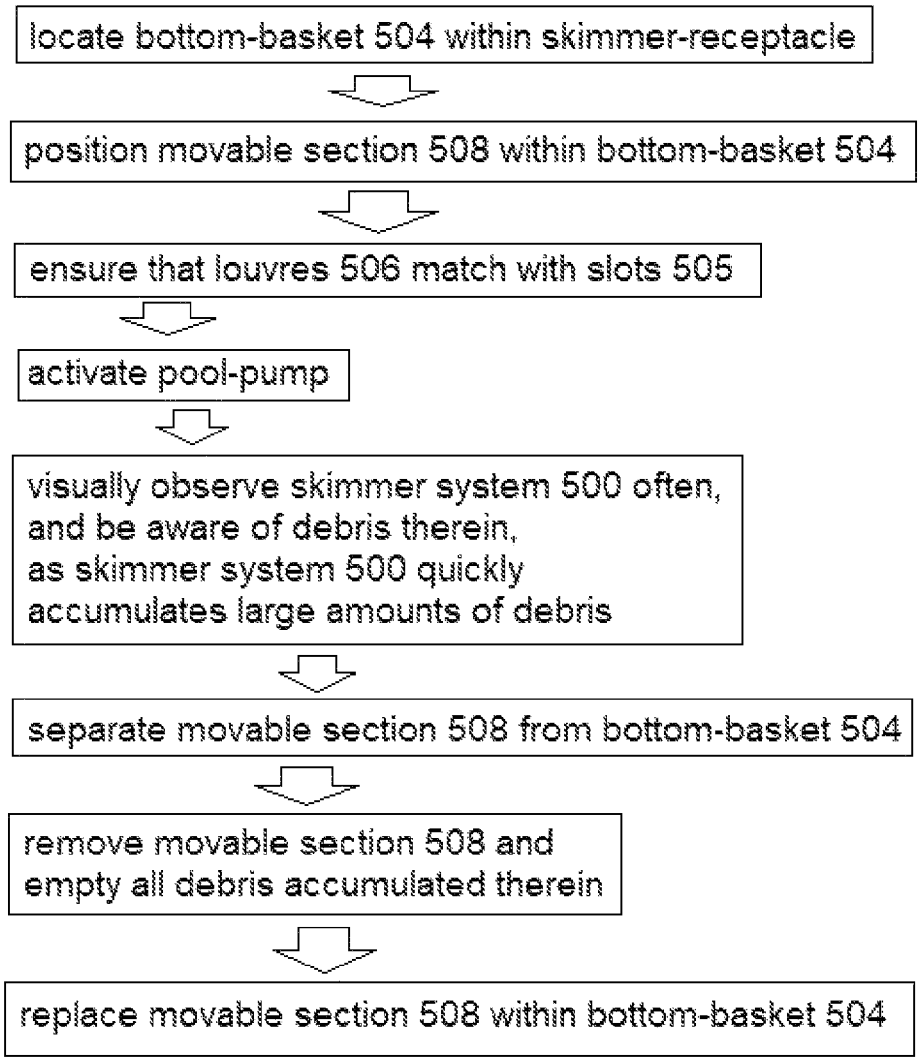
FIG. 12A (method of use)

MODIFIED POOL SKIMMER

BACKGROUND

A typical swimming pool is equipped with at least two filtering mechanisms. A first mechanism is the filter mechanism and pump, which strives to filter all the water in the pool, top to bottom. The other mechanism is a skimmer or skimming infrastructure that is more targeted at just the top surface of the water. That is, targeted only at the debris still-floating on the surface of the pool water. The intent of the skimmer mechanism is to more quickly capture this surface debris, right away, preferably before it becomes water-logged and is still somewhat lighter, and before it sinks to the bottom of the pool.

In most pools, unwanted debris starts out as mere surface debris, and it's a lot better to try to remove it from the surface, before it sinks. Once any debris sinks to the bottom of a pool, the debris is much harder to recover, and the typical pump and filter mechanisms may not ever recover it. Instead, it may become necessary to vacuum or scrape or otherwise manually capture the sunken debris.

Additionally, when a serious amount of rainfall occurs within an outdoor pool, a key function/feature of a conventional skimming infrastructure is defeated. If the conventional skimming infrastructure is submerged, by e.g. 1 or 2 inches of additional water, its ability to perform surface-skimming is lost. When a conventional skimming infrastructure becomes submerged, debris may come near it but only by accident, and will likely just float away and not be captured.

A similar problem occurs if the water-level goes below the level of the conventional skimmer. In such a case, no water is skimmed. Consequently, a mechanism for improving the capture-rate and efficacy of a pool skimming infrastructure is desired.

BRIEF DESCRIPTION OF THE DRAWINGS

FIG. 6 shows a rim of the moving section and a foreseeable range spanning a significant distance 'd'.

FIG. 12A shows a flowchart of a method of use of the skimmer system.

DETAILED DESCRIPTION OF PREFERRED EMBODIMENTS

A typical pool skimming infrastructure is shown in FIGS. 1-4 (Prior Art). The embodiments herein will work effectively within any pool having a conventional skimming infrastructure.

Figure 1:
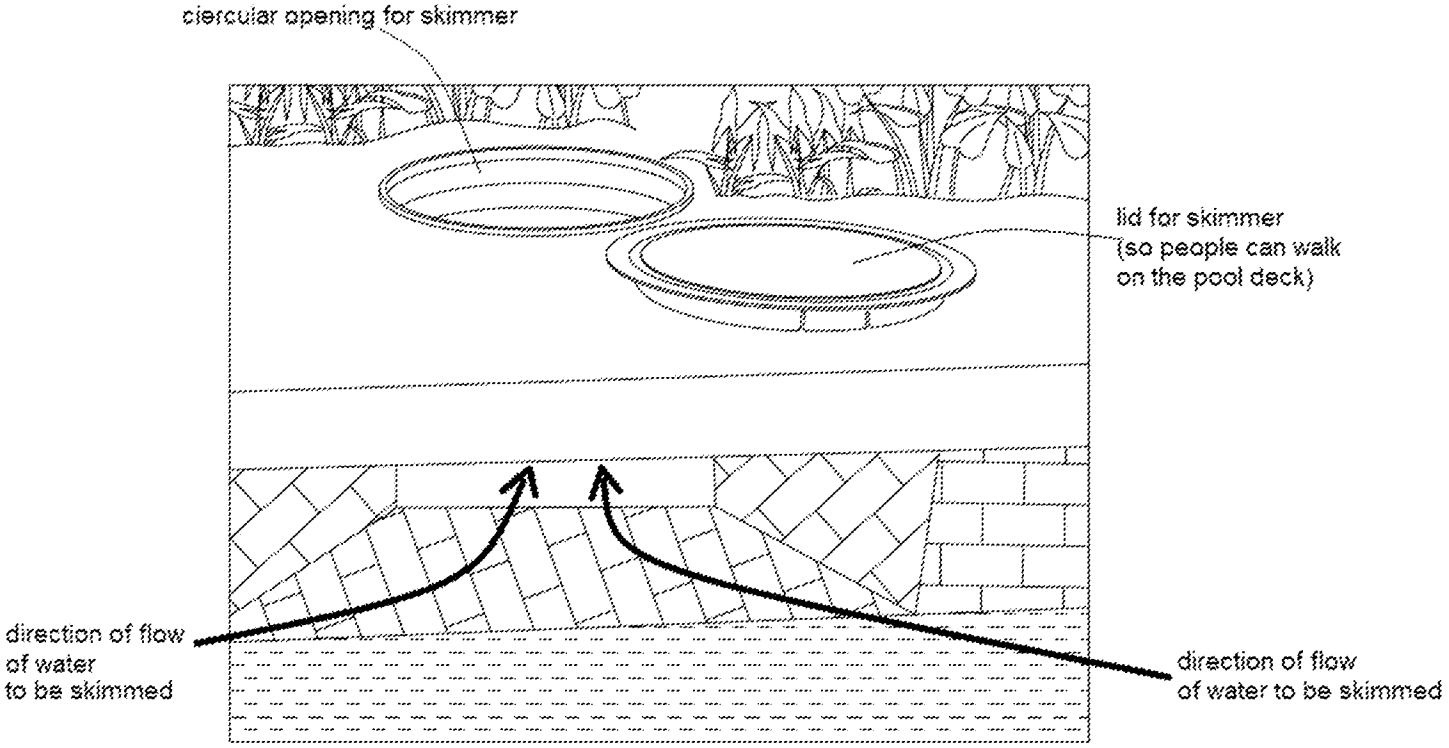
FIG. 1 (prior art)
FIGS. 1, 2, 3, and 4 (Prior Art) show a conventional pool skimming infrastructure.
Figure 2:
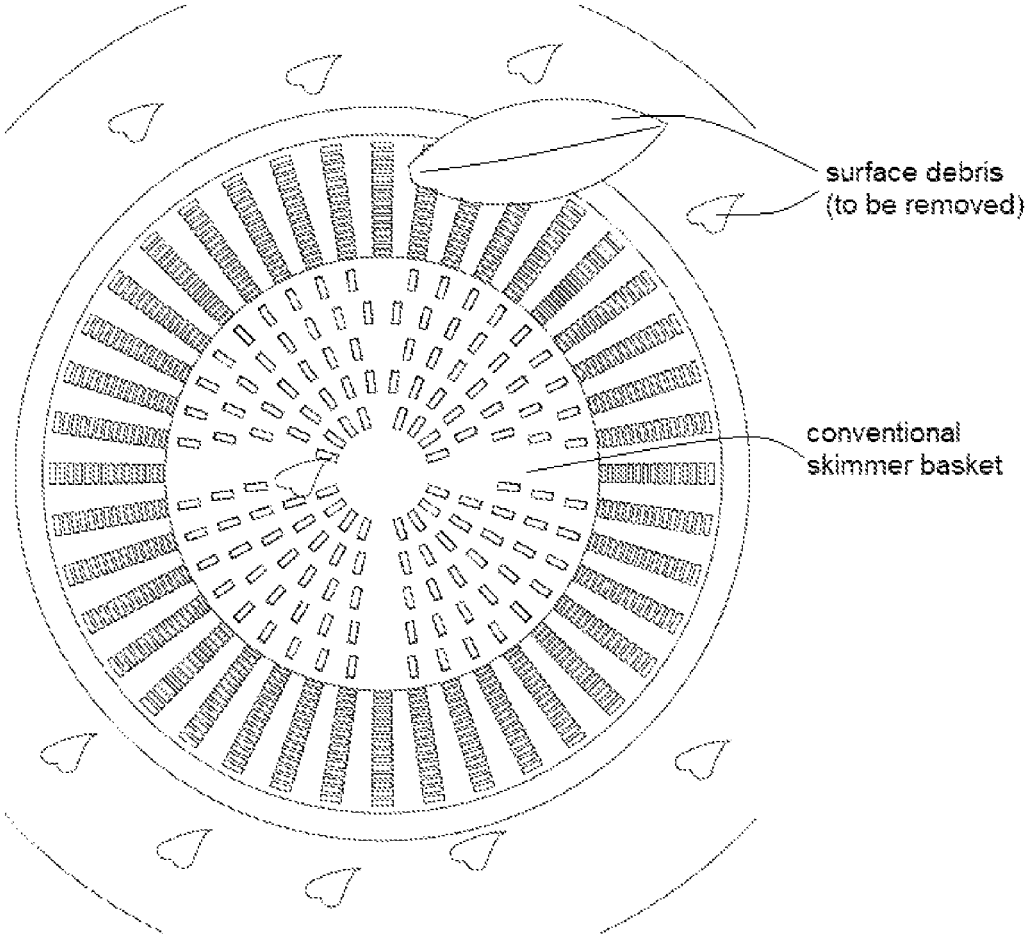
FIG. 2 (prior art)
Figure 3:
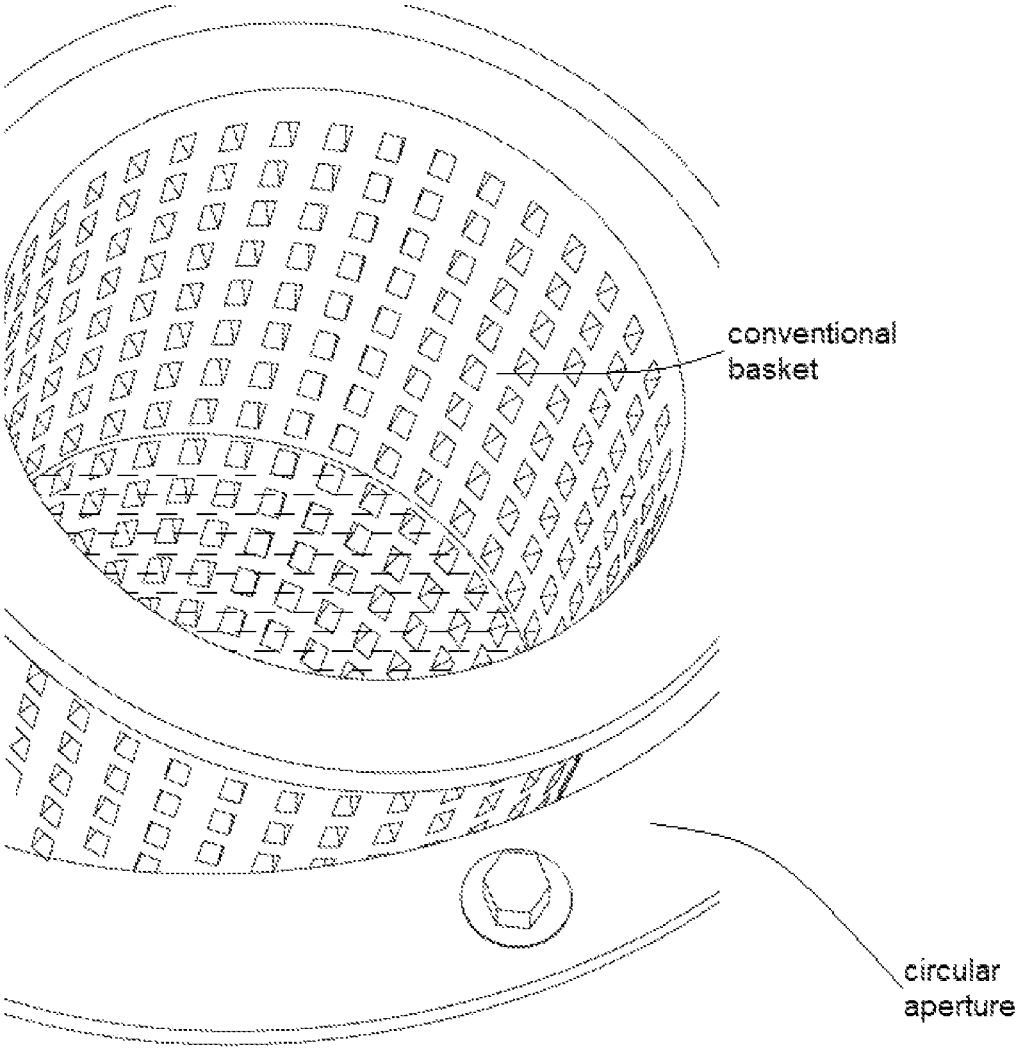
FIG. 3 (Prior Art)
Figure 4:
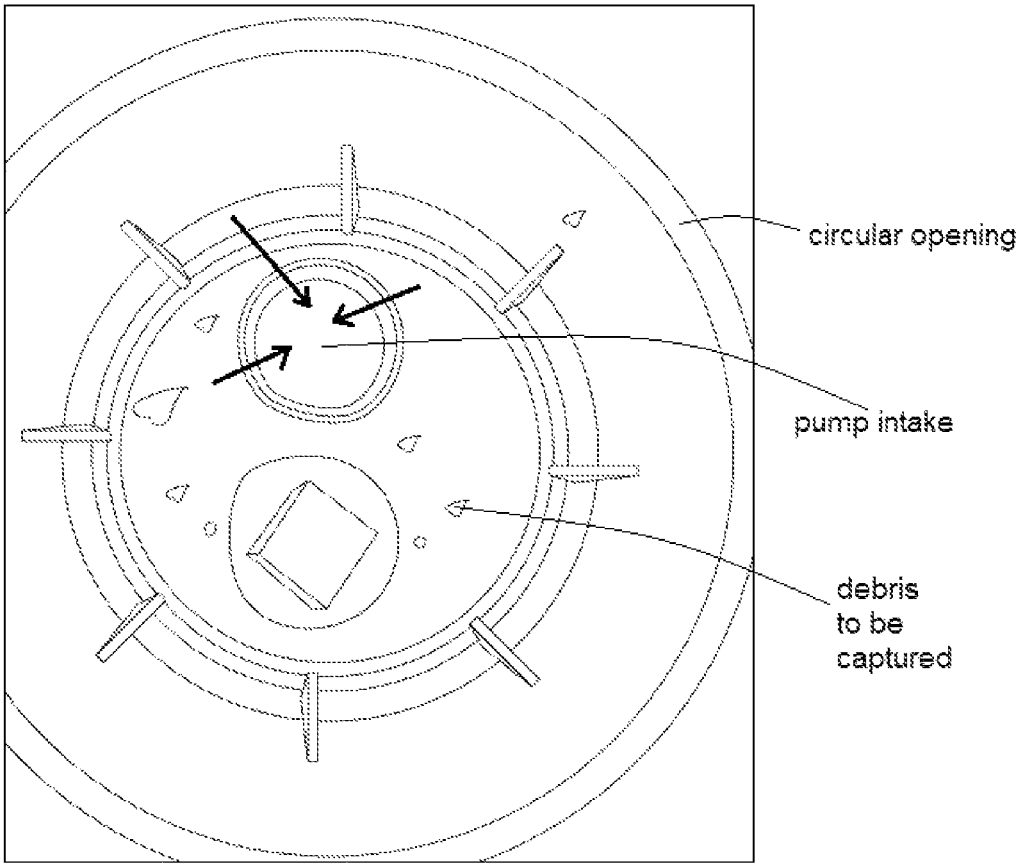
FIG. 4 (Prior Art)

For convenient reference, a Prior Art stationary basket is shown being inserted and removed in FIGS. 2 and 3 (Prior Art). In a conventional stationary skimming mechanism, pool water (and debris) stream through the Prior Art basket via suction, which directs the pool water into and through the conventional skimmer basket.

As stated, a conventional skimmer mechanism is easily defeated by just a bit of rain. Once the water level rises about the water-line, the skimming basket will not catch anything. Its only necessary to raise the water level by an inch or so to make a conventional pool skimmer cease being effective.

Figure 5A:
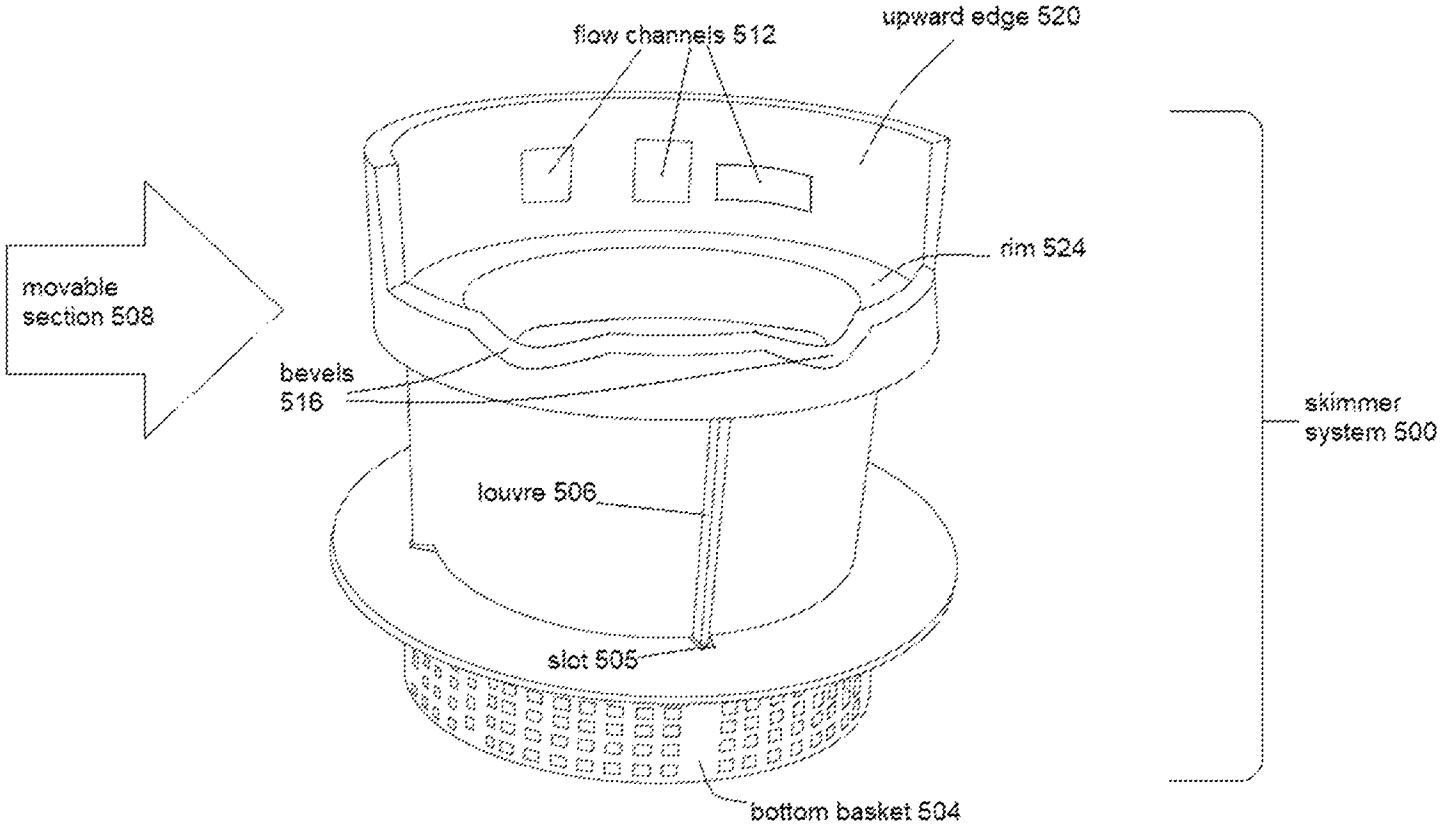
FIGS. 5A and 5B show an embodiment of an improved skimmer system comprising a base-basket and a moving section, where the moving section has two or more louvres defined therein.
Figure 5B:
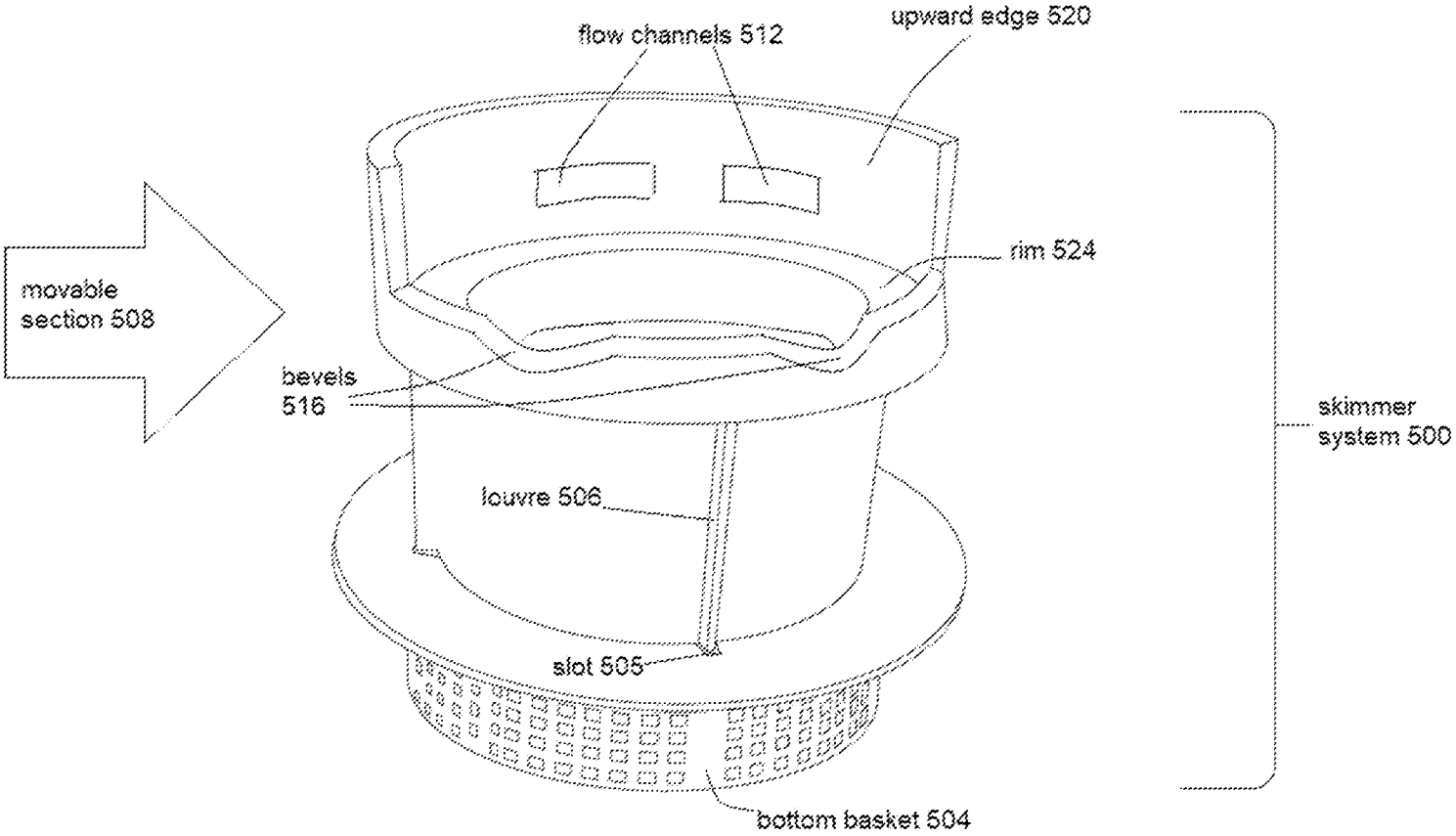

To address these and other issues, FIGS. 5A-5B show an embodiment of an improved skimmer system 500, comprising a base-basket 504 and a moving section 508, where the moving section 508 has two or more louvres 506 defined therein. During use, the base-basket 504 will likely remain stationary, but the moving section 508 will float-travel along a vertical axis defined by the louvres 506. Accordingly, using the skimmer system 500 enables effective skimming regardless of potential changes in level of the pool water, as shown at least within FIG. 6. The louvres 506 within the moving section 508 correspond with a plurality of slots 505 within the base-basket 504.

Installation

During installation of the system 500, a user would first position the base-basket 504 within the bottom of any (existing) circular opening (see FIGS. 1 and 4) which normally houses a pool skimmer. To properly install the system 500, a user must first make sure that the base-basket 504 is properly fitted into its seat, which is not difficult. Then, the user takes the movable section 508 and loads it in on top of the base-basket 504. In doing so, the user should ensure the louvres 506 match up with the slots 505 in the base-basket 504.

Use

During use of the system 500, when pool water is being pumped, a specific type of enhanced water-flow (vacuum) is created partly by the flow channels 512 and bevels 516 within the moving section 508. FIG. 5A differs from FIG. 5B in that FIG. 5A has 3 flow channels 512, while FIG. 5B has 2 flow channels 512 that are both rectangular. This is to illustrate the fact that the system 500 can have a variety of numbers of flow channels 512, in a variety of shapes, depending on the needs of a specific pool.

Specifically, as the moving section 508 goes up and down traveling inside of the slots 505, the rim 524 of the moving section 508 is always near to or at the same level as the surface of the pool water, within a foreseeable range spanning a significant distance 'd' (see FIG. 6). This in turn reinforces the principle that the skimmer system 500 is functional and on-duty a much larger percentage of the time than conventional skimmer systems, which spend a considerable amount of time out of action and non-helpful because they are unable to adjust to changes in water-levels. In other words, conventional skimmers have very minimal distance of travel.

Figure 7:
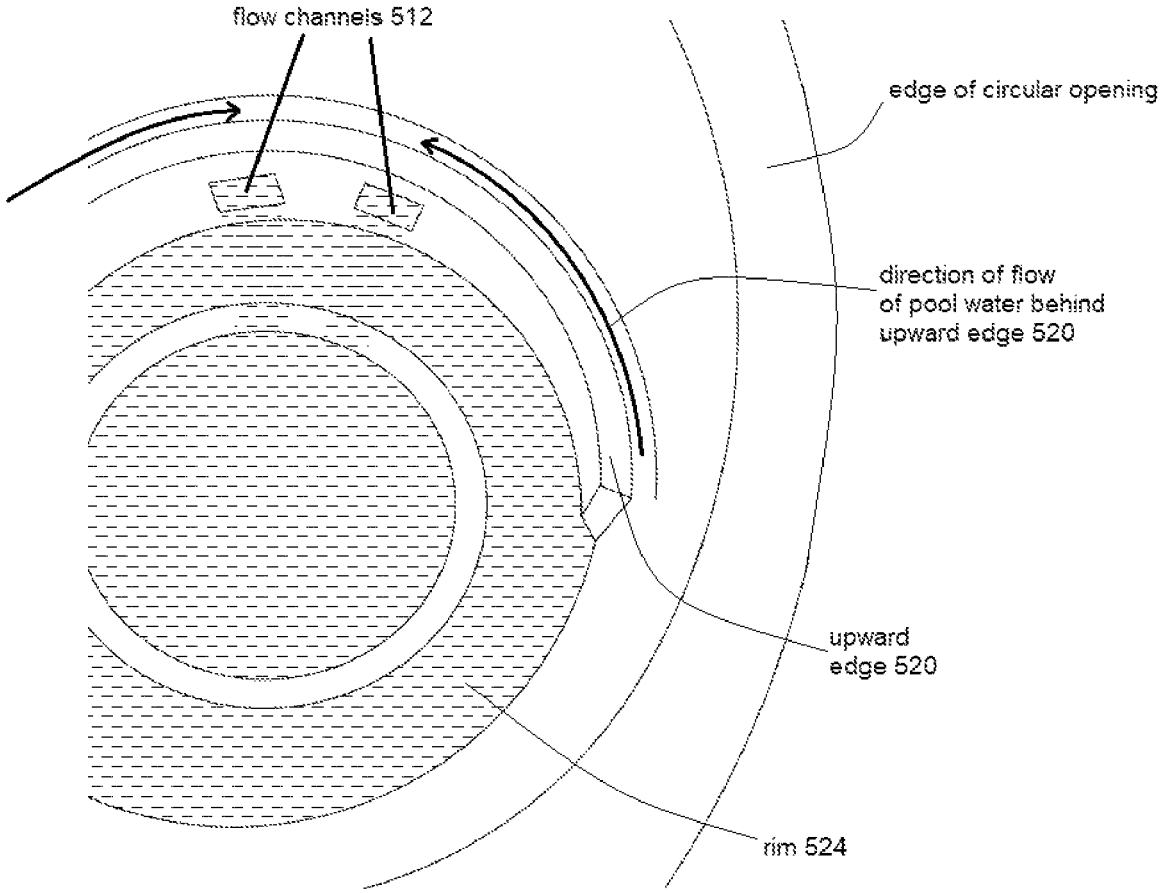
FIG. 7 shows a potential way of operating the improved skimmer system, and its effects.

Increased water-flow advancement occurs partly by pool water sloshing and flowing behind the upward edge 520, which then flows through the flow channels 512 and downward through the bottom-basket 504. Meanwhile, surface debris tends to seep just over the edge of the moving section 508 because of the welcoming invitation by the proprietary bevels 516. Then, the surface debris is further retained within the moving section 508 partly due to the downward force provided by the pool water flowing through the flow channels 512, as shown in FIG. 7. In any case, once the debris flows into the moving section 508, like the proverbial roach motel, the surface debris does not flow out. Surface debris flows in, but does not flow out, and instead is captured.

Figure 8:
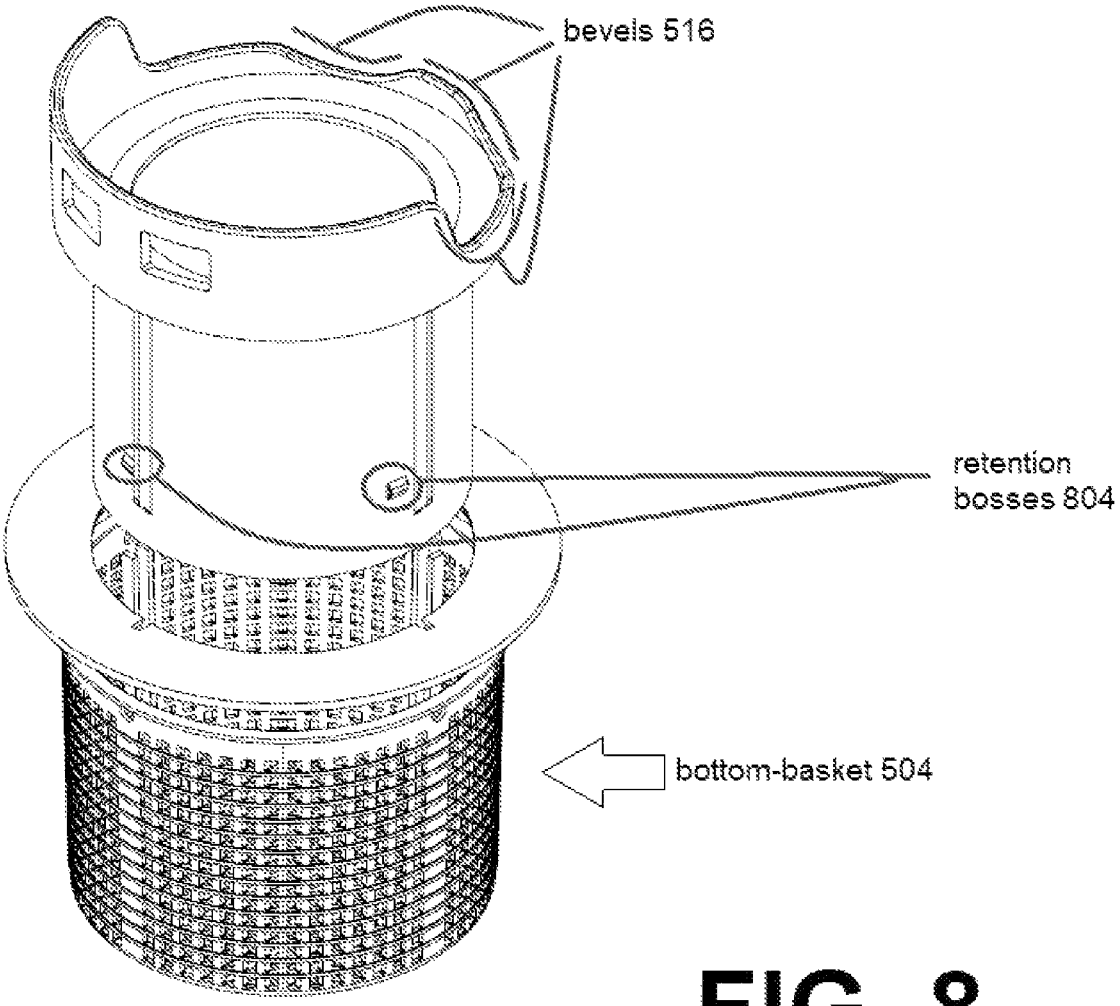
FIG. 8 shows another view of the skimmer system, including a potential implementation of one or more retention bosses, bevels, and shape of the bottom-basket.

FIG. 8 shows another view of the system 500, including a potential implementation of one or more retention bosses 804. These retention bosses 804 act as a type of capture mechanism, and prevent the movable portion 508 from entirely escaping (separating from) the bottom-basket 504. One instance where the movable portion may be subject to a considerable amount of force is during a rogue wave such as a person doing a "cannonball" into the pool. The specific arrangement of the retention bosses 804 shown in FIG. 8 is for example purposes only, and should not be considered limiting, as this feature can be implemented a variety of ways.

FIG. 8 also shows a larger bottom-basket 504 than what is shown in FIGS. 5A-5B. The bottom-basket 504 can be made in a variety of sizes and configurations.

Next, FIGS. 5A, 5B, and 8 all show the bevels 516, which are designed to accelerate water flow and improve skimming efficiency. The bevels 516 are shown with a specific contour in FIGS. 5A, 5B, and 8, but this is for illustration only and should not be considered limiting. The contour and curvature of the bevels 516 can vary according to: a) type and size of debris (e.g. types of leaves being captured); b) viscosity of the water in the pool; c) turbulence and shape of the pool, and d) humidity in the ambient air.

Methods of Manufacture

The molds used for making the various sections within the system 100 will be split top and bottom around the rim 524, however the bottom will have four sliders that will form the louvres 506. This in turn avoids the need to draft top to bottom. This technique also allows the retention bosses 804 to be formed at the same time and in the same way as the louvres.

All parts within the system 100 can be manufactured from polypropylene, as this material is inexpensive and resistant to chemicals and UV. Further, all parts within the system 100 will require dynamic dies with sliders therein, to facilitate demolding to occur without having any undercut issues.

Figure 9:
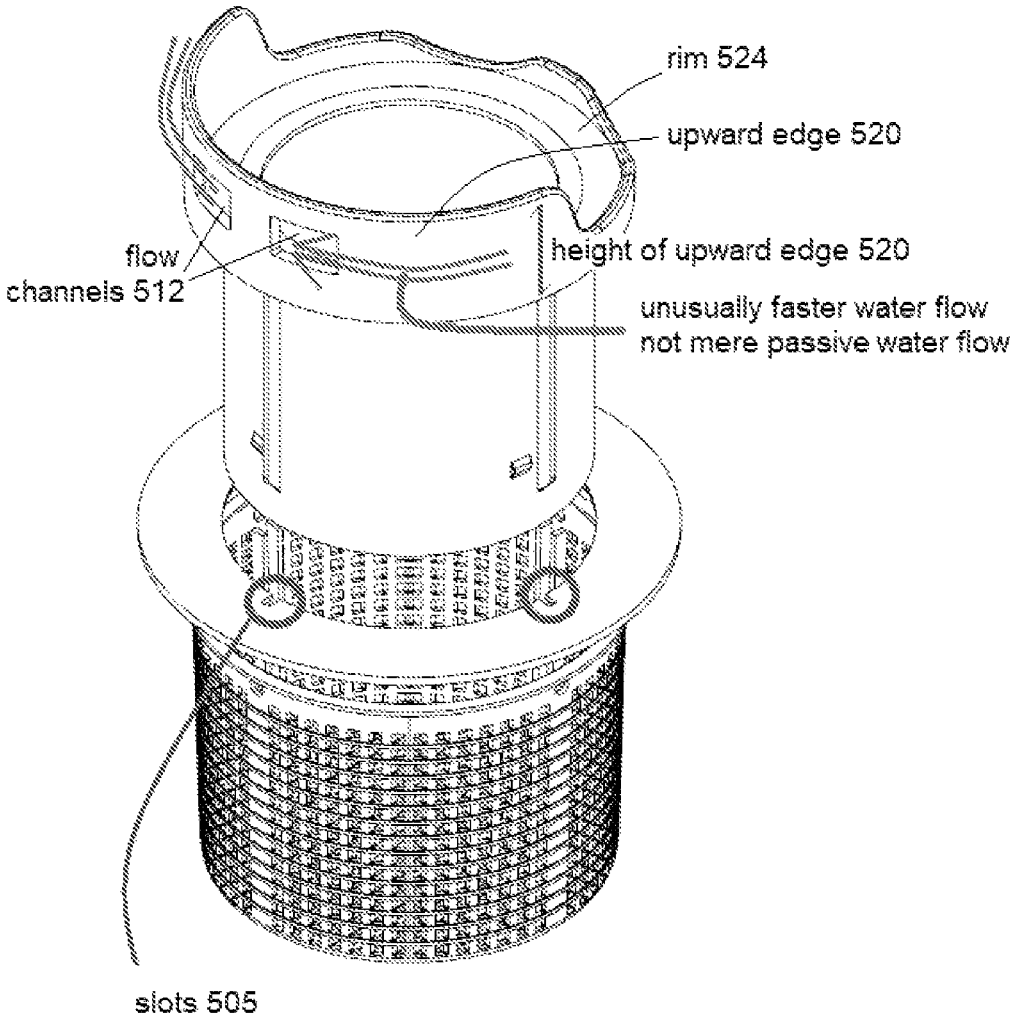
FIG. 9 shows details of the rim and upward edge within the movable section, and of slots within the base-basket.

FIG. 9 shows some more details about how the system 100 will be manufactured. In order to accommodate differences between flow rates from one pool to another, the embodiments herein can vary the buoyance of the movable section 508. This can be accomplished by including several float-rings that can be added as needed as follows:

a) inside or outside the movable section 508; or b) under the retention bosses 804 within the movable section 508.

Figure 14B:
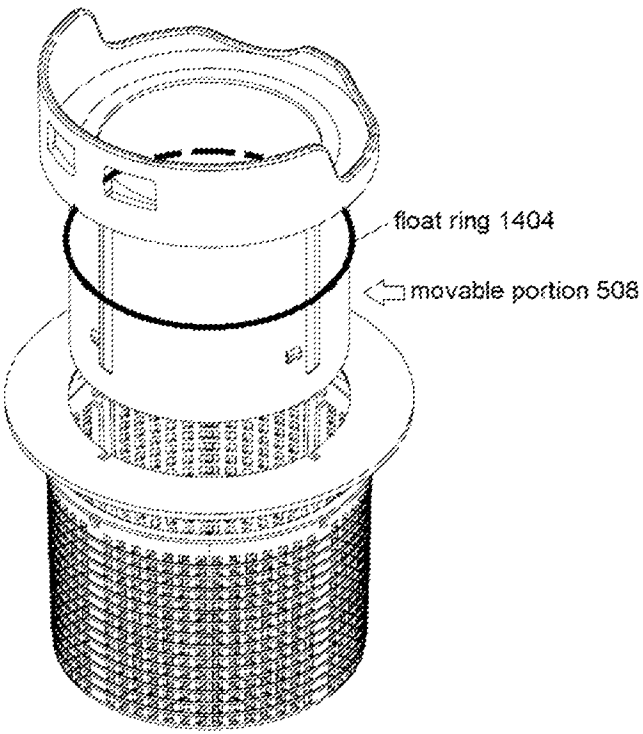
FIGS. 14A and 14B show some potential implementations of float-rings attached to the movable portion.
Figure 14A:
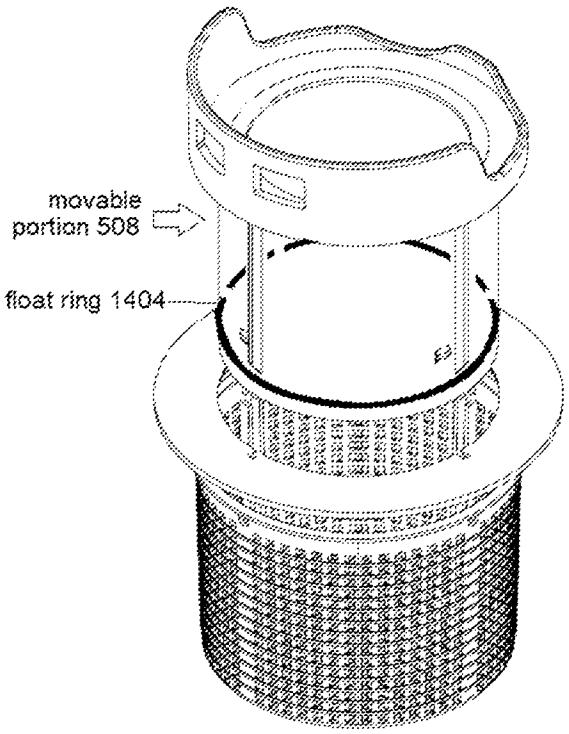

FIGS. 14A and 14B show some potential implementations of float-rings 1404 attached to the movable portion 508.

Next, during manufacturing, if the slots 505 are made too narrow, the louvres 506 might stick and inhibit vertical movement. Meanwhile, if the slots 505 are too wide, the louvres 506 could be subject to strong horizontal forces and not freely move vertically, so that the overall system 100 could be impeded from capturing debris effectively. To address these and other concerns, an embodiment exists in which the louvres 506 and the slots 505 have a predetermined amount of draft or taper therein, so that they may remain sufficiently loose to freely travel vertically, but not rotate. Such a fit also ensures the movable section 508 stays parallel with the bottom basket 504 and reduces occurrence of pitch, rotate, or yawl.

FIG. 9 also shows the rim 524 and upward edge 520 within the movable section 508. The system 100 works best when the rim 524 is flat, as skimming occurs with maximum efficiency in this configuration. Meanwhile, the height of the upward edge 520 is designed to fit well within existing pool skimmer enclosures, yet facilitate water intake at its rear, through the proprietary apertures. The height of the upward portion 520 is configured to take maximum advantage of the Bernoulli principle, in which the speed of a moving fluid increases in proportion to the narrowness of the aperture through which it travels. A sufficient height of the upward edge 520 assists in achieving an optimal narrowness of the aperture between the movable portion 508 and the basket 504. However, excessive height of the upward edge 520 may cause the movable section 508 to not fit within existing pool structures.

Figure 10:
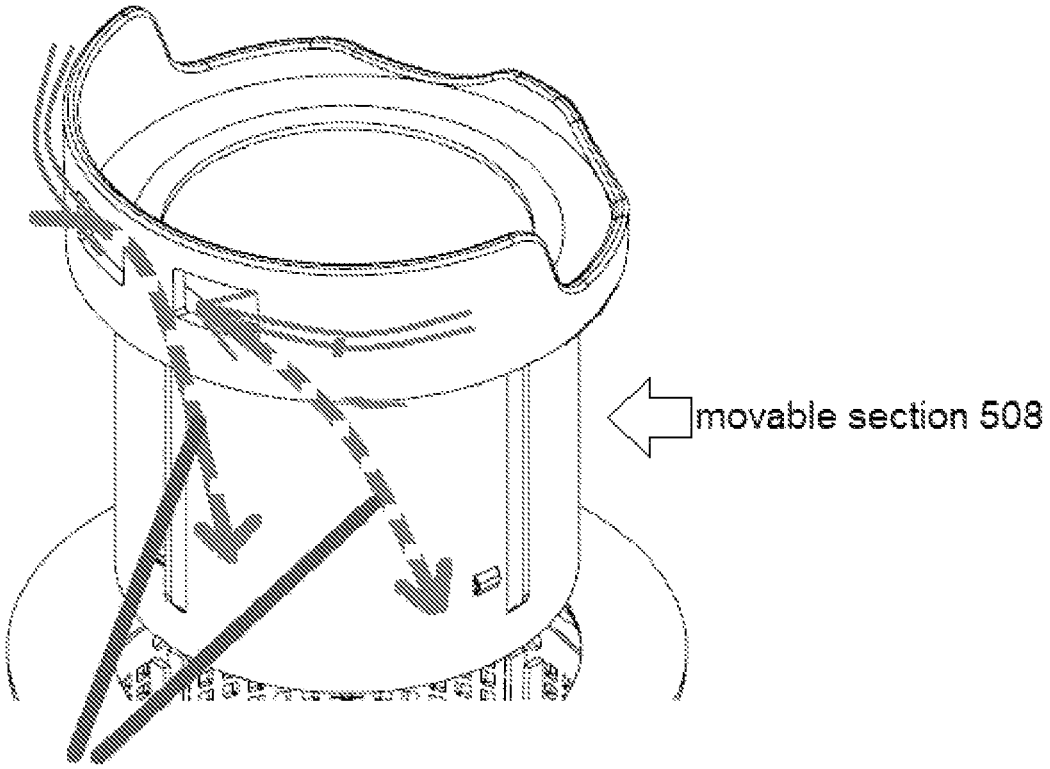
FIG. 10 shows an example flow-draft of pool water passing through the skimmer system.
Figure 11A:
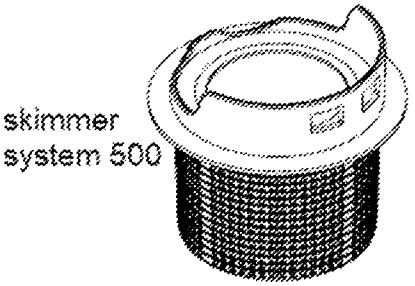
FIGS. 11A, 11B, 11C, and 11D show more views of the skimmer system, fully assembled.
Figure 11B:
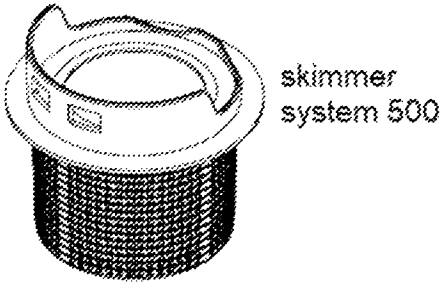
Figure 11C:
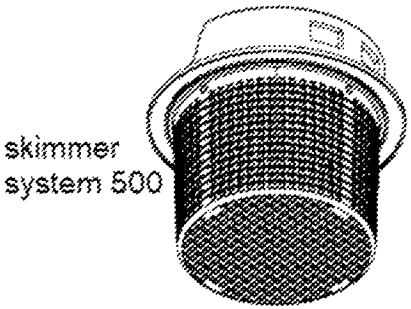
Figure 11D:
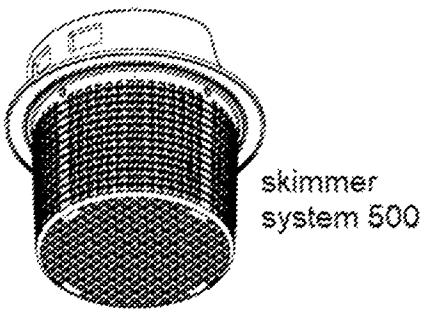

Finally, other sizes, shapes, and numbers of the flow channels 512 can be other than what is shown in FIGS. 5 and 9-10. Also, a distance between the flow channels 512 and the rim 520 can vary.

FIG. 10 shows an example flow-draft of pool water passing through the system 100. The design of the system 100 ensures that some portion of the water flowing through it travels downward at a high rate, thereby trapping debris and increasing the "roach motel" effect. Some of this is of course caused by the water-pump which is part of a typical pool arrangement. However, another effect is that a vortex-effect is created, such that the movable portion 504 is not pulled down by the water pump, but instead the vortex causes the movable portion 504 to rise and float more effectively, and stay level, and not be sucked downward by the pump's effects.

FIGS. 11A, 11B, 11C, and 11D show more views of the skimmer system 500, fully assembled.

FIG. 12A shows a flowchart of a method of use of the skimmer system 500.

Figure 12B:
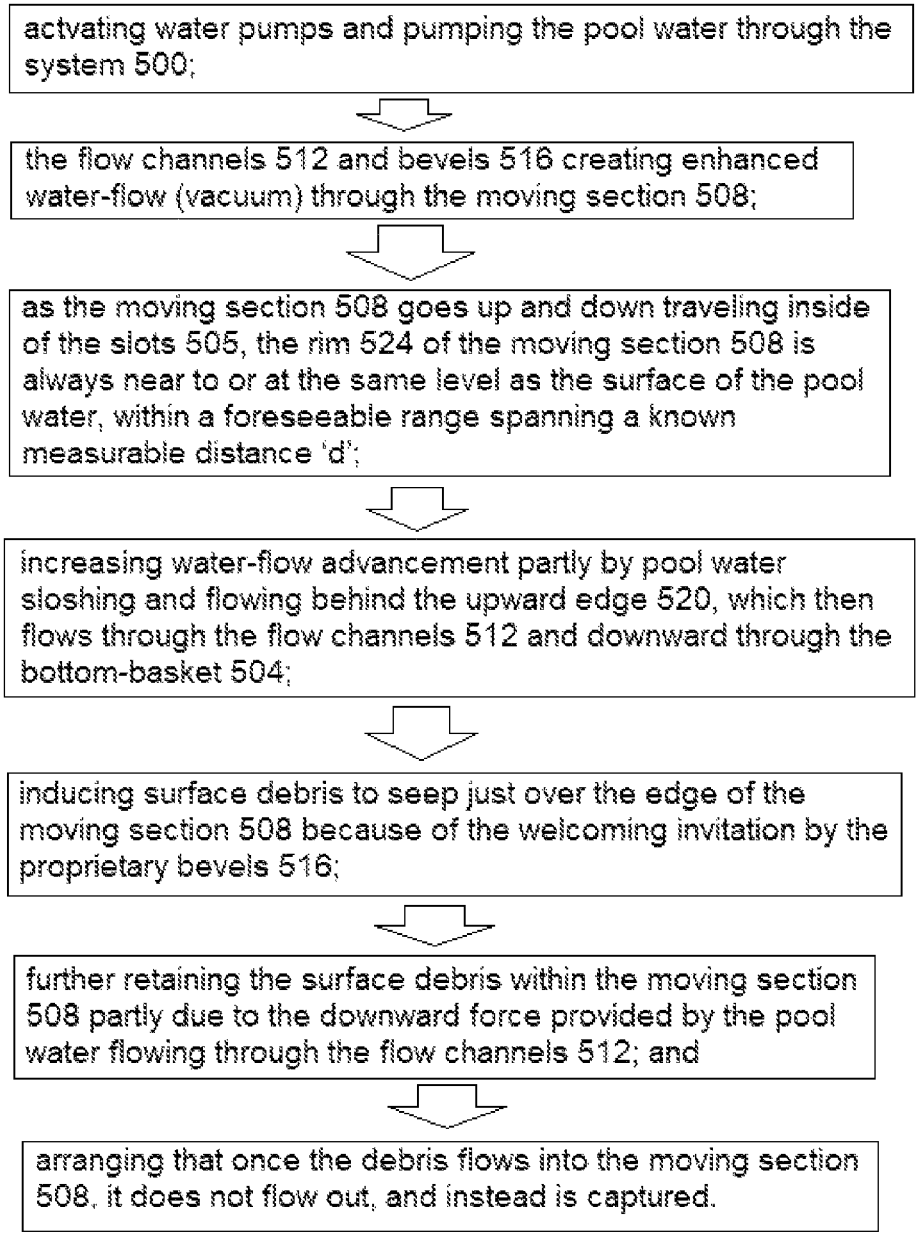
FIG. 12B shows a flowchart of another method of use of the skimmer system.

FIG. 12B shows a flowchart of another method of use of the skimmer system 500.

Figure 13:
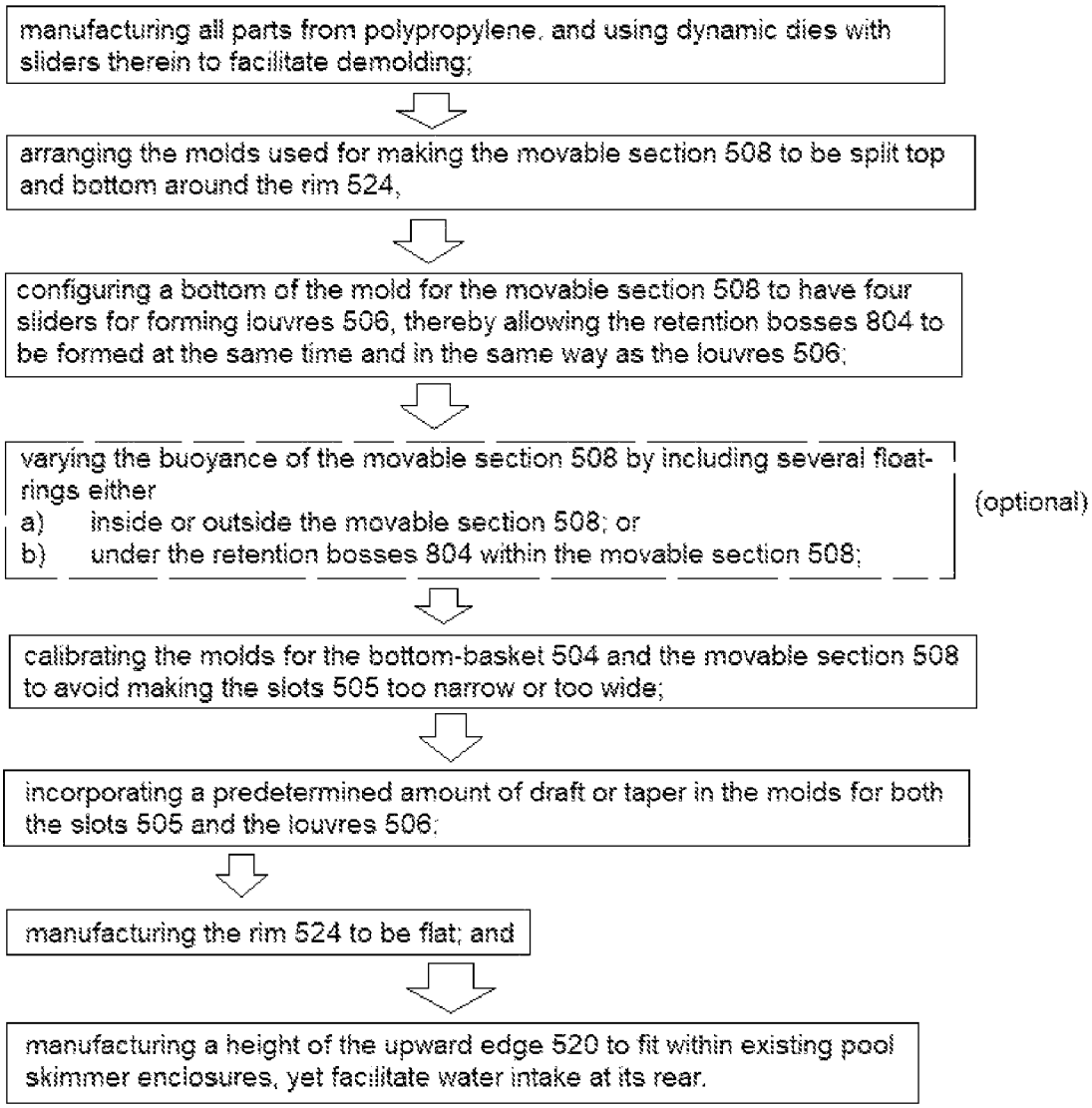
FIG. 13 shows a flowchart of a method of manufacturing of the skimmer system.

FIG. 13 shows a flowchart of a method of manufacturing of the skimmer system 500.

Disclaimer

While preferred embodiments of the present invention have been shown and described herein, it will be obvious to those skilled in the art that such embodiments are provided by way of example only. It is not intended that the invention be limited by the specific examples provided within the specification. While the invention has been described with reference to the aforementioned specification, the descriptions and illustrations of the embodiments herein are not meant to be construed in a limiting sense. Numerous variations, changes, and substitutions will now occur to those skilled in the art without departing from the invention.

Furthermore, it shall be understood that all aspects of the invention are not limited to the specific depictions, configurations, or relative proportions set forth herein which depend upon a variety of conditions and variables. It should be understood that various alternatives to the embodiments of the invention described herein may be employed in practicing the invention. It is therefore contemplated that the invention shall also cover any such alternatives, modifications, variations, or equivalents. It is intended that the following claims define the scope of the invention and that methods and structures within the scope of these claims and their equivalents be covered thereby.

What is claimed is:

1. A method of manufacturing a skimmer system, comprising:

configuring a base-basket to be cylindrical and having a first diameter;

configuring a moving section to be cylindrical and having a second diameter;

configuring the second diameter to be less than the first diameter but where the moving section staying in movable contact with the base-basket;

configuring the moving section with vertical louvres on its exterior;

configuring the base-basket with vertical slots on its interior;

matching the louvres with the slots such that during use of the system, the base-basket remaining stationary but the moving section float-traveling along a vertical axis defined by the louvres.

2. The method of claim 1, further comprising:

locating a plurality of retention bosses on the moving section; and configuring the base-basket to have a stopping effect corresponding with the retention bosses.

3. The method of claim 2, further comprising:

the retention bosses acting as a type of capture mechanism preventing the moving section from entirely escaping and separating from the bottom-basket.

4. The method of claim 1, further comprising:

configuring the moving section with one or more bevels having a first contour/configuration to enhance water flow at a predetermined threshold suitable for accelerating water flow and improving skimming efficiency.

5. The method of claim 4, further comprising:

varying the contour and curvature of the one or more bevels according to type and size of surface debris expected in a particular pool-environment.

6. The method of claim 5, further comprising:

varying the contour and curvature of the one or more bevels according to type and size of pool, and a volume of water passing through the skimmer system.

7. The method of claim 1, further comprising:

splitting two molds for making the movable section around a horizontal rim within the movable section thereby resulting in top and bottom molds;

applying molding material within the top and bottom molds;

performing a molding process, thereby resulting in various sections within the system being split top and bottom around the rim.

8. The method of claim 7, further comprising:

configuring a bottom of the mold used for making the moving section to have four sliders, thereby forming the louvres; and forming the retention bosses.

9. The method of claim 7, further comprising:

the molding material for all parts comprising polypropylene.

10. The method of claim 9, further comprising:

configuring the molds for all parts within the system to have dynamic dies with sliders therein; thereby facilitating demolding of the various sections to occur without undercutting.

11. The method of claim 10, further comprising:

configuring the molds for the movable section such that the louvres and the slots emerge from the mold with a predetermined amount of draft or taper therein, so that the louvres and the slots may remain sufficiently loose to freely travel vertically but not rotate; thereby ensuring that the moving section stays parallel with the base-basket and does not pitch, rotate, or yawl.

12. The method of claim 1, further comprising:

configuring a height of the rear edge of the moving section to fit within existing pool filter enclosures, yet facilitate water intake through one or more apertures.

13. The method of claim 12, further comprising:

configuring the height of the rear edge of the moving section for achieving an optimal narrowness of an aperture between the moving section and the basket; thereby taking maximum advantage of a fact that a speed of a moving fluid increases in proportion to the narrowness of the aperture through which it travels.

14. The method of claim 1, further comprising:

including one or more float-rings with the moving section; thereby varying a buoyancy of the movable section.

15. The method of claim 14, further comprising:

locating the one or more float rings inside the moving section.

16. The method of claim 14, further comprising:

locating the one or more float rings outside the moving section.

17. The method of claim 14, further comprising:

locating the one or more float rings under a filter retention flange at the top of the moving section.

* * * * *